US006704526B2

(12) United States Patent
Nakamura

(10) Patent No.: US 6,704,526 B2
(45) Date of Patent: Mar. 9, 2004

(54) IMAGE HEATING APPARATUS ADAPTED FOR CLEANING OF SPEED DETECTION MARK

(75) Inventor: Tomokazu Nakamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/101,854

(22) Filed: Mar. 21, 2002

(65) Prior Publication Data

US 2002/0141773 A1 Oct. 3, 2002

(30) Foreign Application Priority Data

Mar. 28, 2001 (JP) ..... 2001-091869

(51) Int. Cl.[7] ..... G03G 15/20
(52) U.S. Cl. ..... 399/68; 399/67; 399/327
(58) Field of Search ..... 399/67, 68, 98, 399/99, 320, 322, 327, 328, 329

(56) References Cited

U.S. PATENT DOCUMENTS 3,716,018 A * 2/1973 Ohta et al. ..... 399/327 X
4,506,973 A * 3/1985 Ernst ..... 399/99
5,157,444 A * 10/1992 Mori et al. ..... 399/329
5,157,446 A * 10/1992 Kusaka ..... 399/326
5,391,450 A 2/1995 Nagatsuka et al. ..... 430/99
6,108,500 A * 8/2000 Ohkama et al. ..... 399/67

FOREIGN PATENT DOCUMENTS

| | | | |
|---|---|---|---|
| JP | 02-163788 | * | 6/1990 |
| JP | 05-019653 | * | 1/1993 |
| JP | 6-318007 | | 11/1994 |
| JP | 08-190298 | * | 7/1996 |
| JP | 2000-315027 | * | 11/2000 |

* cited by examiner

*Primary Examiner*—Sandra Brase
(74) *Attorney, Agent, or Firm*—Fitzpatrick, Cella, Harper & Scinto

(57) ABSTRACT

The image heating apparatus has a heating body, an endless belt moving in contact with the heating body, a pressing member forming a nip for nipping and conveying a recording material in cooperation with the endless belt, detecting device for optically detecting the mark portion of the endless belt, control device for controlling a driving speed of the endless belt, based on output of the detecting device, and an electroconductive cleaning member for cleaning the mark portion. In the image heating apparatus, the endless belt has a mark portion.

9 Claims, 7 Drawing Sheets

IMAGE HEATING APPARATUS ADAPTED FOR CLEANING OF SPEED DETECTION MARK

BACKGROUND OF THE INVENTION

1. Field of the Invention

The present invention relates to image heating apparatus suitably applied as a fixing device for image forming apparatus such as copiers, printers, and the like which use the electrophotographic method and the electrostatic recording method.

2. Description of the Related Art

In the image forming apparatus, e.g., copiers, LBPs, facsimile machines, microfilm reader printers, etc., there is heating apparatus of a film heating method as one of practical equipment of heating apparatus (image heating apparatus and image heating-fixing apparatus) performing a process of heating and fixing an unfixed toner image according to image information, which was formed and borne in the indirect (transferring) method or in the direct method on a surface of a recording material (a transferring material sheet, an electrofax sheet, an electrostatic recording sheet, a printing sheet, etc.) with a visualizing agent (toner) of hot melt resin or the like by appropriate image forming process means of electrophotography, electrostatic recording, magnetic recording, and so on, into a permanently fixed image on the surface of the recording material.

This is heating apparatus of the method and structure having a heating body fixedly supported, a heat resisting film (fixing film) conveyed opposing and urged against the heating body, and a pressing member which keeps a recording material as a heated material in close fit with the heating body through the film. The apparatus is adapted to apply heat of the heating body through the film to the recording material to heat and fix the unfixed image formed and borne on the surface of the recording material.

As well as the fixing apparatus, the heating apparatus can also commonly be used as means for heating a heated body, e.g., apparatus constructed to heat a recording material bearing an image to improve the surface property (gloss or the like) thereof, prefixing means, and so on.

The heating apparatus of the film heating method allows use of the heating body with low heat capacity or a thin film capable of increasing the temperature at a high increase rate and thus has the advantages of capability of power saving and reduction of wait time (quick start property), capability of lowering temperature increase in the interior of the main body of the image forming apparatus or the like, and so on, thus being effectively applicable.

However, there occurs variation in the nip conveyance speed of the heated material by the apparatus, depending upon the temperature condition of the constitutive members. For example, when the apparatus is of a pressing member driving type of driving and rotating the pressing (pressurizing) member (hereinafter referred to as a pressing roller) urged through the film against the heating body, thereby sliding the film on the heating body and also nipping and conveying the film, or the film and the heated material together through a press nip portion between the heating body and the pressing roller, the outside diameter of the pressing roller increases because of thermal expansion of a rubber portion with increase in the temperature of the pressing roller during operation of the apparatus.

Since the pressing roller is normally rotated at a fixed rotational speed, the thermal expansion of the pressing roller becomes greater at high temperatures than at low temperatures to increase the peripheral velocity of rotation, thereby increasing the nip conveyance speed of the heated material. Namely, the heating apparatus yields the difference of the nip conveyance speed of the heated material, depending upon the temperature condition of the pressing roller.

For this reason, since the conveyance of the recording material is kept at a prescribed speed at an image forming portion, e.g., an image transferring portion as an upstream processing portion located upstream of the heating apparatus, when the recording material arrives at the recording material press nip portion (fixing portion) of the heating apparatus from the transferring portion to go into a nip conveyance state, there arises a state in which the recording material nip conveyance speed at the fixing portion of the heating apparatus is larger in a high temperature state of the heating roller than the recording material conveyance speed at the transferring portion, so that in this state the heating apparatus pulls the recording material to cause an image blur at the transferring portion.

In a low temperature state of the pressing roller, an unwanted loop (sag) is formed in the recording material at the recording material conveying portion between the transferring portion and the fixing portion of the heating apparatus making unstable the direction of separation of the recording material after the transfer of the image at the transferring portion. Also unstable is the angle of entrance of the recording material to the fixing portion of the heating apparatus, resulting in a scattering of the image upon the transfer or the separation, an offset at the fixing portion of the heating apparatus, and so on. When the passing recording material is thick, a blur can occur at the transferring portion because of firmness (rigidity) of the recording material.

In order to solve the problems caused by the pulling phenomenon of the recording material and the unwanted loop forming phenomenon resulting from the variation of the recording material nip conveyance speed of the heating apparatus as described above, Applicant proposed a method of detecting the speed of the fixing film, estimating the conveyance speed of the recording material, based thereon, and controlling the driving speed of the pressing roller (Japanese Patent Application Laid-Open No. 08-190298).

There is an embodiment of the method having detecting means for detecting the speed of the film by use of a light reflecting portion reflecting light from a reflection sensor, which is provided at least at one end of the film, and control means for controlling the speed of the film, based on the speed of the film detected by the detecting means. When the driving speed of the pressing roller is controlled by this control means so as to keep the rotating speed of the fixing film always constant, the recording material is always conveyed at a fixed conveyance speed and this prevents the aforementioned pulling of the recording material and formation of the unwanted loop, so as to enable attainment of stable images.

However, untransferred toner normally floats inside the main body of the image forming apparatus and long-term use will result in deposition of toner on the surface of the light reflecting material. This can result in decreasing the reflected light from the light reflecting material and eventually failing to detect the rotational speed of the fixing film. For this reason, the recording material will not be conveyed at the desired conveyance speed, so as to produce abnormal images.

SUMMARY OF THE INVENTION

An object of the present invention is to provide image heating apparatus causing no irregularity of imagery.

Another object of the present invention is to provide image heating apparatus capable of keeping the conveyance speed of the recording material constant.

Still another object of the present invention is to provide image heating apparatus capable of correctly detecting a speed of an endless belt.

Still another object of the present invention is to provide image heating apparatus comprising:

a heating body;

an endless belt moving in contact with the heating body, the endless belt having a mark portion;

a pressing member forming a nip for nipping and conveying a recording material in cooperation with the endless belt;

detecting means for optically detecting the mark portion of the endless belt;

control means for controlling a driving speed of the endless belt, based on output of the detecting means; and an electroconductive cleaning member for cleaning the mark portion.

Further objects of the present invention will become apparent from the following description.

DESCRIPTION OF THE PREFERRED EMBODIMENTS

Embodiments of the present invention will be described below on the basis of the drawings.

(1) Overall Structure of an Example of Image Forming Apparatus

Figure 1:
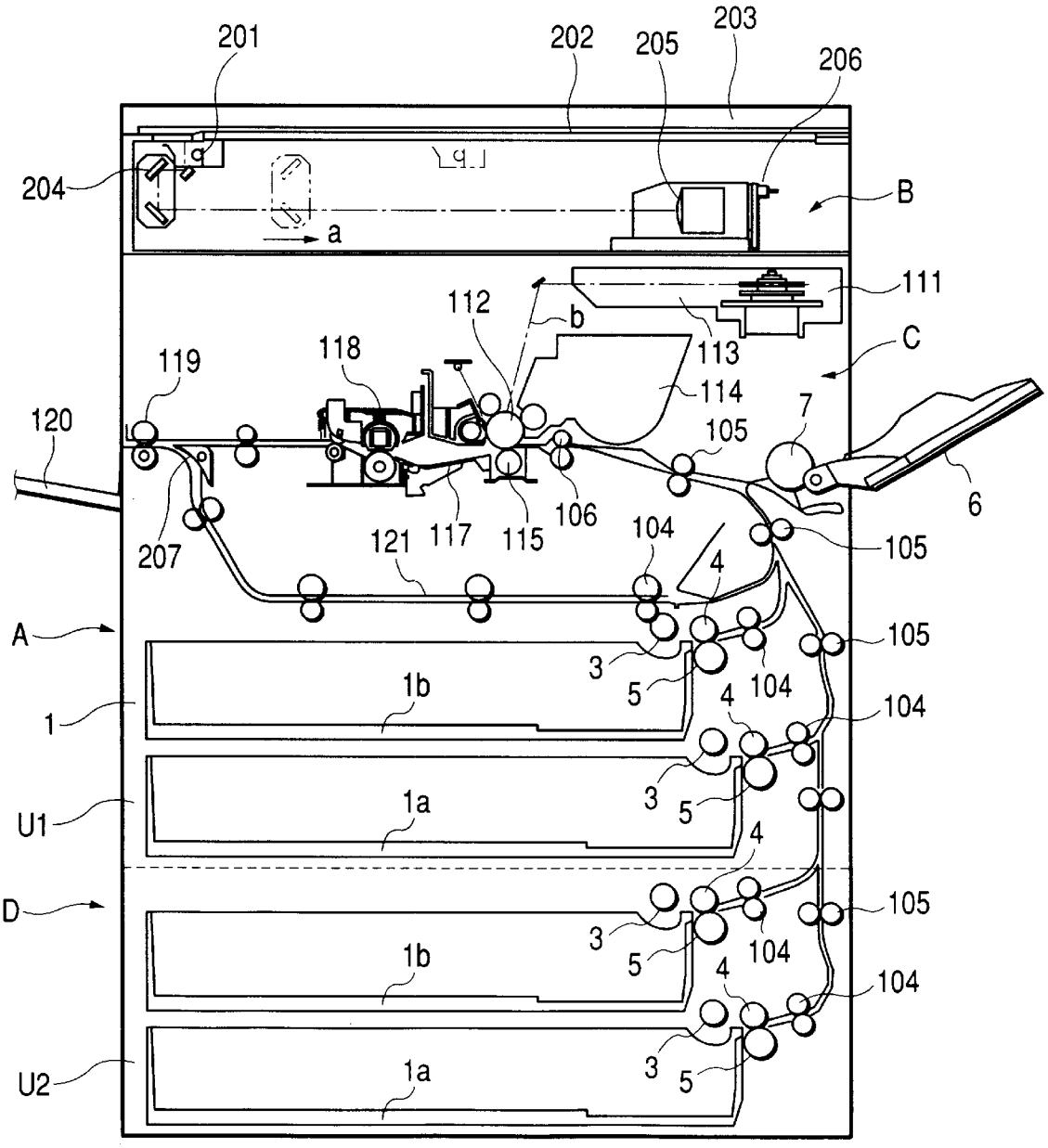
FIG. 1 is a schematic illustration of an example of image forming apparatus.

FIG. 1 is a schematic illustration to show an image forming apparatus using an image heating apparatus in the present embodiment as a fixing apparatus. The image forming apparatus of the present embodiment is a multifunctional image forming apparatus provided with an image reading scanner portion and using the transferring type electrophotographic process.

The main body A of this image forming apparatus is comprised of an image reading scanner portion B as image reading means for reading image information on an original, which is located in the upper part; an image forming portion C as image forming means located below the scanner portion B; and a sheet deck D incorporated below the image forming portion C.

a) Image Reading Scanner Portion B

Numeral 202 designates a glass platen horizontally fixed, on which a book original or a sheet original such as a book, a thick sheet, a curl sheet, or the like is mounted according to either of predetermined mount references with an image surface to be read facing down and is set in a still state in which the back surface of the original is pushed by an original pressing plate 203.

When an operator pushes a read start key, a movable scanning unit, which is disposed on the lower surface side of the glass platen 202 and which includes a scanning system light source 201, a scanning system mirror 204, etc., is forwardly driven at a predetermined speed in the direction of an arrow a, which is a direction toward the right edge side, from a home position indicated by a solid line on the left edge side of the glass platen, along the bottom surface of the glass platen.

This causes the downwardly facing image surface of the original mounted and set on the glass platen 202 to be sequentially illuminated and scanned from the left edge side to the right edge side, whereby reflected light of the illuminating and scanning light from the original surface is guided through a lens 205 into a light receiving element (photoelectric conversion element) 206 to be photoelectrically read thereby. An electric signal thus read is processed in an image processing portion to be converted into an image information electric signal and the image information electric signal is transferred to a laser scanner 111 in the image forming portion C.

When the movable scanning unit arrives at a predetermined end point of the forward motion, it is then backwardly moved back to the start home position.

b) Image Forming Portion C

Figure 2:
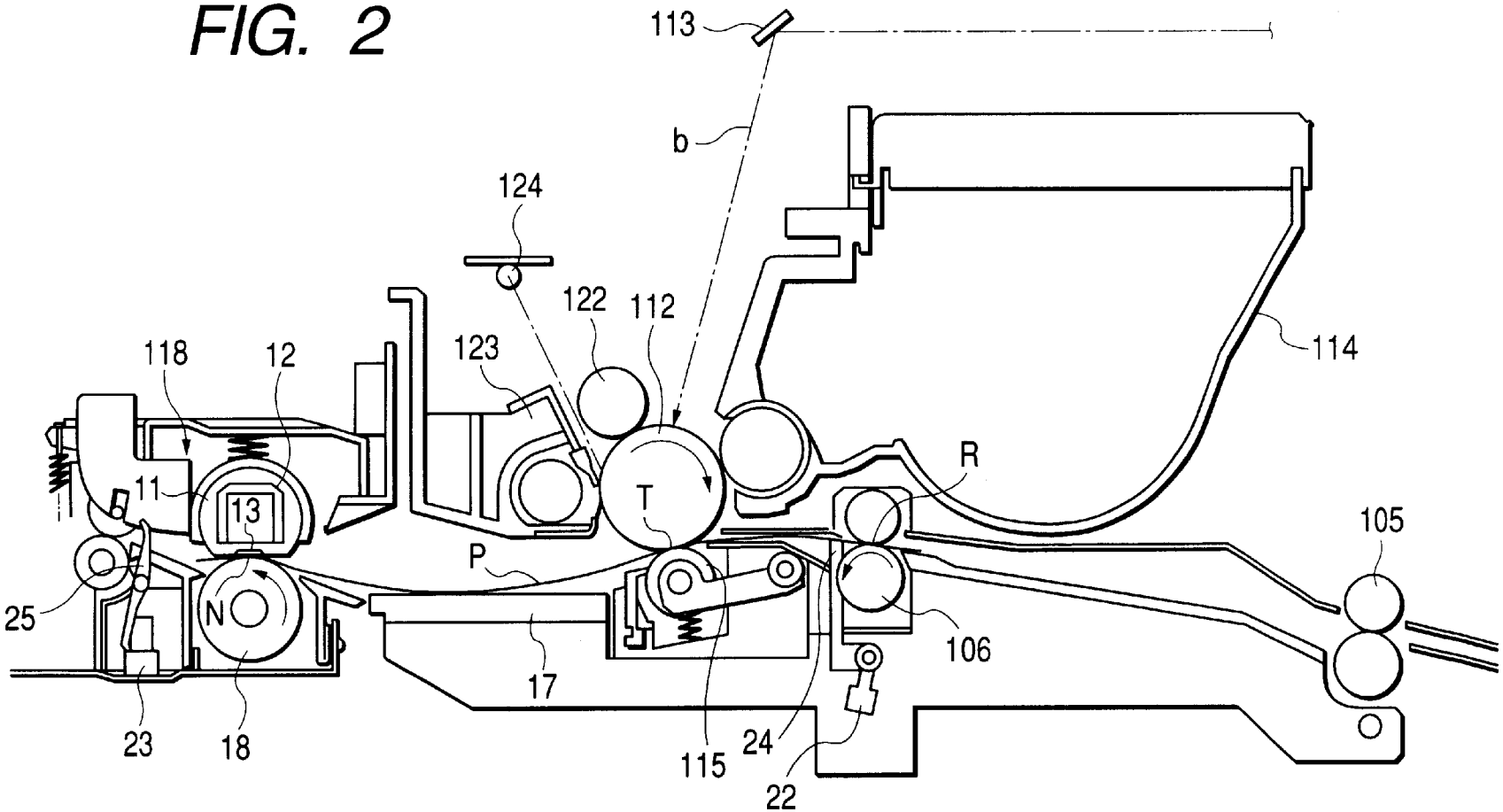
FIG. 2 is an enlarged view of the major part of an image forming portion.

FIG. 2 is an enlarged view of the major part of the image forming portion C. Referring to FIGS. 1 and 2, numeral 112 designates an electrophotographic, photosensitive body of a rotary drum type (hereinafter referred to as a photosensitive drum) as an image bearing body. This photosensitive drum 112 is rotated clockwise at a predetermined peripheral velocity (process speed) and during the rotating process thereof, the photosensitive drum 112 is uniformly charged in a predetermined polarity and at a predetermined potential by a charging device 122. The uniformly charged surface is exposed to laser scanning exposure light b according to image information from the laser scanner 111 and an image writing optical system 113, whereby an electrostatic, latent image corresponding to a scanning exposure pattern is formed on the surface of the photosensitive drum 112.

The electrostatic, latent image formed on the surface of the photosensitive drum 112 is developed into a toner image by a developing device 114 and the toner image is successively transferred onto a transferring material P (hereinafter referred to as a sheet) as a recording material fed at predetermined control timing from a sheet feed portion side, described hereinafter, into a transferring portion T, at the transferring portion (transfer nip portion) T as a contact nip portion between the photosensitive drum 112 and a transferring-charging roller 115.

The sheet P with the toner image transferred thereonto through the transferring portion T is successively separated from the surface of the photosensitive drum 112, and is conveyed through a conveying portion (sheet conveying guide path) 117 to a fixing apparatus 118 as a fixing portion. In the fixing apparatus, the sheet P is heated and pressed during the nip conveyance process at a fixing nip portion N of the fixing apparatus to fix the unfixed toner image.

After the separation of the sheet, the rotating photosensitive drum 112 is subjected to a process of removing residual attaching contaminants such as transfer residual toner or the like by a cleaning device 123 and is also subjected to a charge eliminating process by an eraser lamp 124 or the like. Then the photosensitive drum 112 is repeatedly used for image formation.

In a single-side print mode, the sheet P having passed through the fixing apparatus 118 is discharged onto a sheet discharge tray (or sorter) 120 located outside the machine, by sheet discharge rollers 119.

Figure 3:
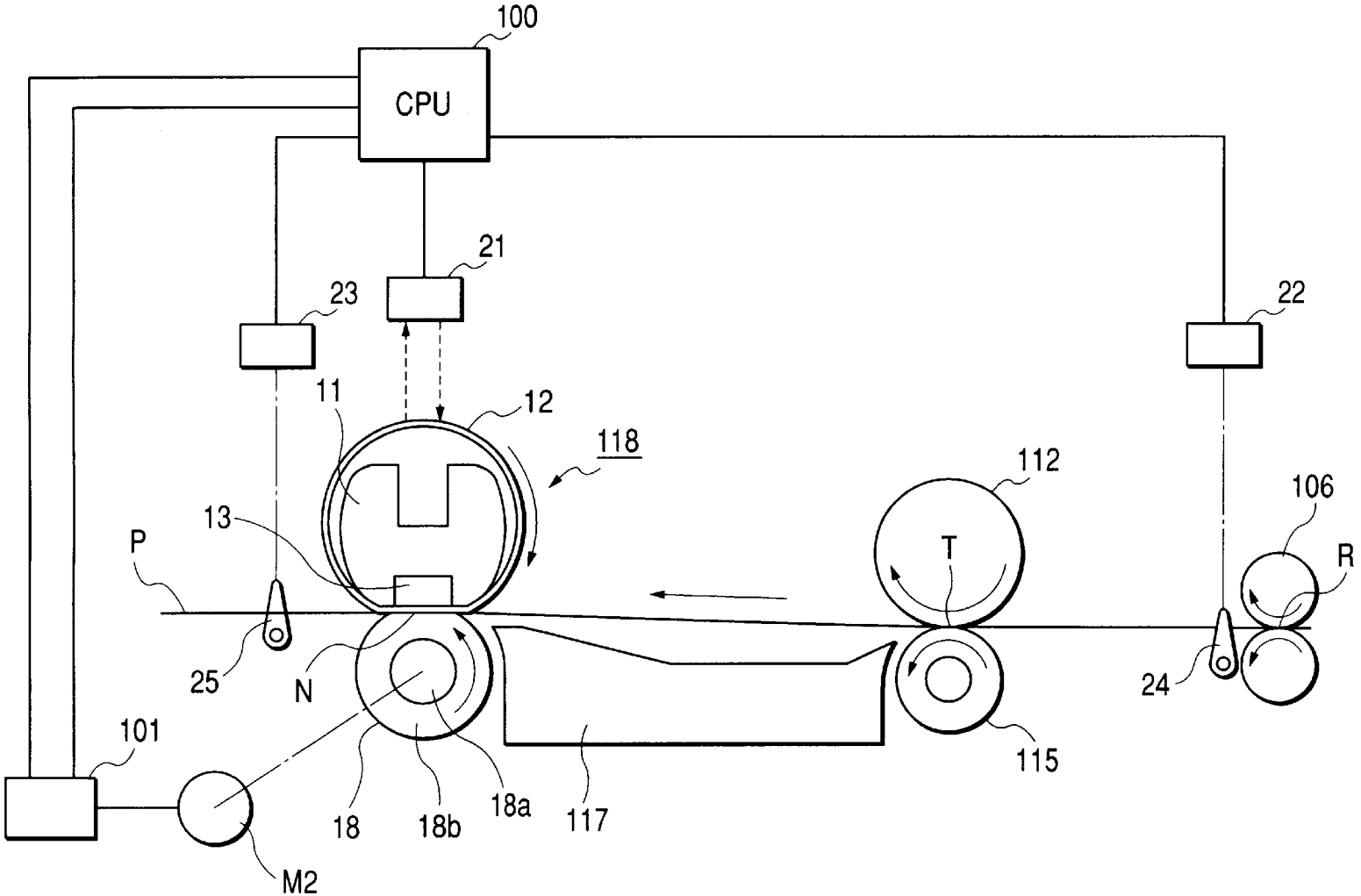
FIG. 3 is a schematic illustration of a fixing apparatus and surroundings thereof, and block diagram of a control system.

Numerals 22 and 23 denote photointerrupters as first and second sheet detecting sensors, respectively, and are provided with their respective flag portions (actuators) 24 and 25 so as to be able to detect arrival and passage of a sheet. Their detection signals are fed into CPU 100 (FIG. 3).

In a dual-side print mode, the sheet after the image formation on the first surface, discharged from the fixing apparatus 118, is pinched by the sheet discharge rollers 119, the sheet discharge rollers 119 are backwardly rotated at a time when the trailing edge of the sheet passes a branch point 207, the sheet is once mounted on a dual-side tray 121, thereafter the sheet is conveyed up to registration rollers 106 by conveying rollers 104 and 105, the sheet is again fed at predetermined control timing into the image transferring portion so as to reverse the front surface and the rear surface of the sheet, an image is then formed on the second surface of the reversed sheet, as described previously, and thereafter the sheet is discharged and loaded onto the sheet discharge tray 120.

The registration rollers 106 has a roller pair of a driving roller and a pinch roller kept in contact with each other, and are arranged to once receive the leading edge of a sheet fed from the sheet feed portion, at a press nip portion R between the pair of rollers in a drive stop state to keep the sheet in a temporary standby state. The registration rollers 106 also have a function of correcting skew feeding of the sheet. The driving roller is actuated at predetermined control timing to rotate at a predetermined peripheral speed, whereby the sheet is fed into the image transferring portion T. When the trailing edge of the sheet passes the press nip portion R between the roller pair, the drive of the driving roller is terminated in order to receive the leading edge of the next sheet.

The main body A of the image forming apparatus herein functions as a copying machine when a processing signal from the image processing portion of the image reading scanner portion B is supplied into the laser scanner 111 as described above, and also functions as a printer when an output signal from an external computer is fed into the laser scanner 111. It also functions as a facsimile apparatus when it receives a signal from another facsimile apparatus or when it transmits the signal of the image processing portion in the image reading scanner portion B to another facsimile apparatus.

c) Sheet Deck D

A sheet cassette 1 is mounted below the image forming portion C and this sheet cassette 1 is constructed as a sheet feed unit has two cassettes, a lower cassette 1*a* and an upper cassette 1*b*. In the present embodiment, two sheet feed units U1 and U2 are mounted so as to allow four cassettes to be mounted. One sheet feed unit U1 located above is detachably mounted on the main body A, while the other sheet feed unit U2 below is detachably mounted on the sheet deck D. A sheet is automatically fed from sheets stored in a cassette selected and specified.

Namely, the sheets stored in the cassette 1*a* or 1*b* are fed out by a pickup roller 3 as a sheet feed rotor and are separated and fed one by one through cooperation of feed roller 4 and retard roller 5. Thereafter, each sheet is conveyed by the conveying rollers 104, 105 to be guided to the registration rollers 106, and then the sheet is fed into the image transferring portion of the image forming portion C so as to be timed with the image forming operation by the rollers 106.

Besides the sheet cassette 1, a manual feed tray 6 is provided on a side face of the main body A and a sheet on the tray 6 is fed to the registration rollers 106 by a manual sheet feed roller 7.

(2) Fixing Apparatus 118

Figure 4:
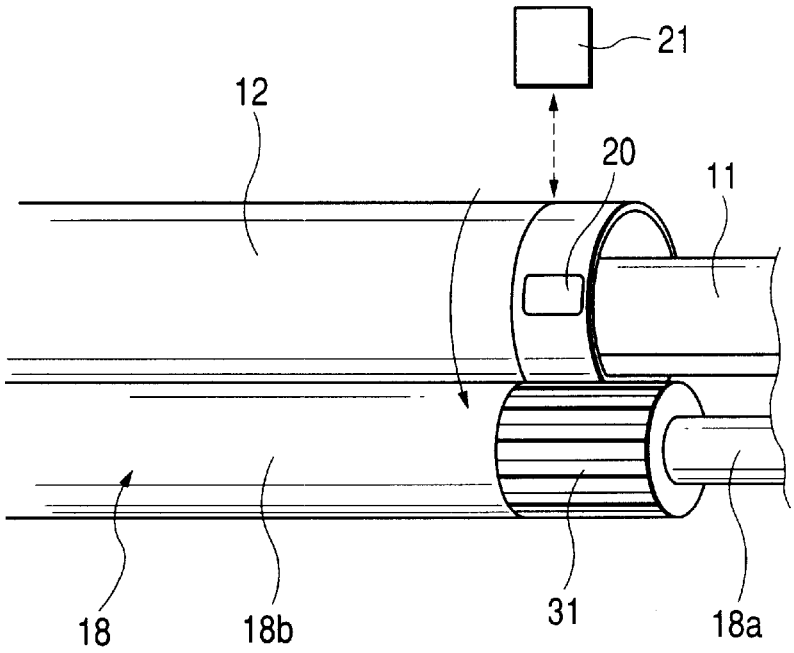
FIG. 4 is an illustration to illustrate a reflecting material on a fixing film, and a detecting sensor.

FIG. 3 is a schematic illustration to show the structure of the fixing apparatus 118 using the image heating apparatus of the present embodiment, and surroundings thereof, and block diagram of a control system. FIG. 4 is a schematic, perspective view of the major part on one end side of the fixing apparatus.

a) Schematic structure of fixing apparatus 118

The fixing apparatus 118 of the present embodiment is a heating apparatus of a pressing member driving method and a tensionless type film heating method.

Numeral 11 designates a stay of heat resisting resin the longitudinal direction of which is a direction normal to the plane of FIG. 3.

Numeral 13 denotes a low-heat-capacity heating body such as a ceramic heater or the like, which is mounted and held along the longitudinal direction of the stay on the lower surface side of the stay 11. The ceramic heater 13 is a totally low-heat-capacity member which is basically composed of a ceramic substrate of thin plate shape with high heat conduction and a resistance heater formed and provided along the longitudinal direction on a surface of the substrate. The ceramic heater 13 quickly heats and increases the temperature with supply of power to the resistance heater and is controlled at a predetermined fixing temperature by a temperature control system.

Numeral 12 designates a heat resisting film (fixing film) of cylindrical shape (endless belt shape) put around the stay 11 including the aforementioned heater 13. The length of the internal circumference of this fixing film 12 is, for example, approximately 3 mm larger than the length of the external circumference of the stay 11 including the heater 13, so that the fixing film 12 is loosely put around the stay 11 including the heater 13, with a margin in the circumferential length.

In order to enhance the quick start property by decrease of the heat capacity of the fixing film 12, the total thickness thereof is determined in the range of about 40 to 100 $\mu$m and a coat layer obtained by adding a conducting agent into a fluororesin such as PTFE (poly(tetrafluoroethylene)), PFA (perfluoroalkoxy), or the like is provided at least on the periphery of a base layer made of a heat resisting material such as a polyimide film or the like with sufficient heat resistance, releasability, strength, durability, and so on.

The fixing film 12 in the present embodiment has totally three or more layers; a base layer of polyimide or the like, a coating layer as a coating of a thin film of a fluororesin or the like on the periphery of the base layer, and a primer layer between the base layer and the coating layer. The primer layer and the coating layer contain carbon black so as to have the electrically conducting or semi-conducting property, and the base layer has the electrically insulating property.

A portion of the fixing film 12 outside the sheet passing region is coated with a reflecting material (marking portion) 20 having a light reflectance higher than that of the film around it, as shown in FIG. 4.

Numeral 18 designates a fixing film pressing roller as a rotor to drive the fixing film 12, which forms a fixing portion N as a press nip portion with the fixing film 12 between the pressing roller 18 and the heater 13. The pressing roller 18 is comprised of a core shaft 18*a* of aluminum, iron, stainless steel, or the like, and a roller portion 18*b* made of an elastic material of heat resisting rubber with good releasability, such as silicone rubber or the like, externally mounted on the shaft, and having the thickness of 3 mm and the outside diameter of 20 mm. The surface of the roller portion 18*b* is coated with a coat layer in which a fluororesin is dispersed, for the reasons of enhancing the conveyance of the sheet P as a recording material and the fixing film 12, preventing toner contamination, and so on.

Numeral 31 denotes a member for cleaning the reflecting material 20 provided on the fixing film 12. The cleaning member 31 is located at an end of the pressing roller 18 on the side corresponding to the reflecting material 20 on the fixing film 12. This cleaning member 31 will be detailed later.

The pressing roller 18 is rotated counterclockwise as indicated by an arrow when the end of the core 18*a* is driven by a motor M2 for driving the fixing apparatus. A torque acts on the fixing film 12 because of a frictional force between the outer surfaces of the pressing roller 18 and the fixing film 12 at the fixing portion N on the basis of the rotational driving of the pressing roller 18. The fixing film 12 is thus rotated clockwise as indicated by an arrow, around the outside of the stay 11 while the internal surface thereof slides in contact on the bottom surface of the heater 13 at the fixing portion N (the pressing member driving method). In this case, it is preferable to place a lubricant such as a heat resisting grease or the like between the fixing film 12 and the bottom surface of the heater 13 in order to decrease the sliding resistance between the internal surface of the fixing film 12 and the bottom surface of the heater sliding in contact therewith.

The stay 11 functions to thermally insulate and hold the heater 13 and serves as a guide member for the internal surface of the fixing film.

In this structure as described above, in a state in which the fixing film 12 is rotated with rotation of the pressing roller 18 and the heater 13 is activated to be temperature-controlled at a predetermined fixing temperature, a sheet P as a recording material with an unfixed toner image formed and borne thereon is conveyed and guided from the image transferring portion R into between the rotating fixing film 12 and the rotating pressing roller 18 at the fixing portion N. While the sheet P is pinched and conveyed together with the fixing film 12 through the fixing portion N, the heat of the heater 13 is imparted through the fixing film 12 to the sheet P to heat and fix the unfixed toner image on the surface of the sheet P. The sheet P having passed through the fixing portion N is curvature-separated and conveyed from the surface of the fixing film 12.

b) Fixing film speed detecting means, and means for varying the driving speed of the apparatus Numeral 21 designates a reflection sensor, which is mounted above a rotational locus position of the reflecting material 20 on the fixing film end side where the reflecting material 20 is formed and provided.

The reflecting material 20 on the fixing film 12 rotates with rotation of the fixing film 12 to pass once per rotation of the fixing film 12 below the reflection sensor 21. The reflection sensor 21 detects reflected light from the reflecting material 20 at each passing time of the reflecting material 20 and sends a signal to the CPU 100.

The CPU 100 calculates a time necessary for one cycle of the fixing film 12 from the detection signal of the sensor and the length of the periphery of the fixing film 12 to determine the rotating speed of the film.

Figure 7:
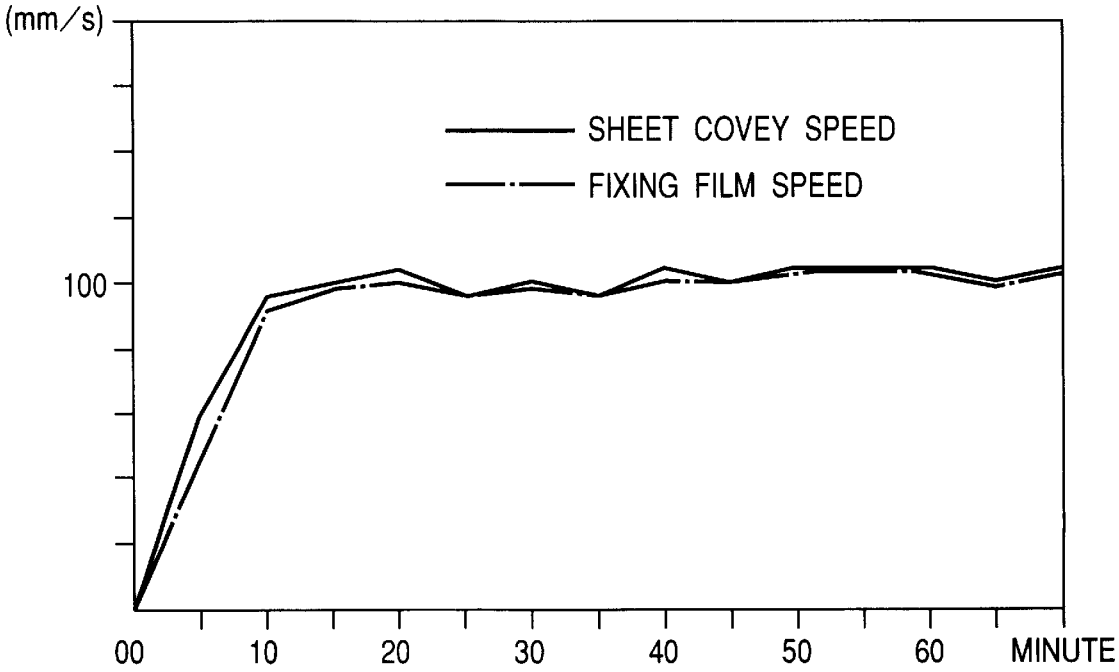
FIG. 7 is a graph to show a correlation between sheet conveyance speed and fixing film speed.

FIG. 7 is a graph to show change in the conveying speed of the sheet P as a recording material and in the rotational speed of the fixing film 12. According to an experiment, as shown in FIG. 7, there is a correlation between the conveying speed of the sheet P and the rotational speed of the fixing film 12. For this reason, the actual conveying speed of the sheet P can be estimated from the rotational speed of the fixing film 12.

Therefore, the CPU 100 controls the speed of the fixing apparatus driving motor M2 through a motor driver 101 so as to decrease the speed of the motor M2 if the rotational speed of the fixing film 12 determined by the input information from the aforementioned reflection sensor 21 is grater than a predetermined speed or so as to increase the speed of the fixing apparatus driving motor M2 if the rotational speed of the fixing film 12 determined by the input information from the reflection sensor 21 is lower than the predetermined speed.

c) Specific control

Figure 8:
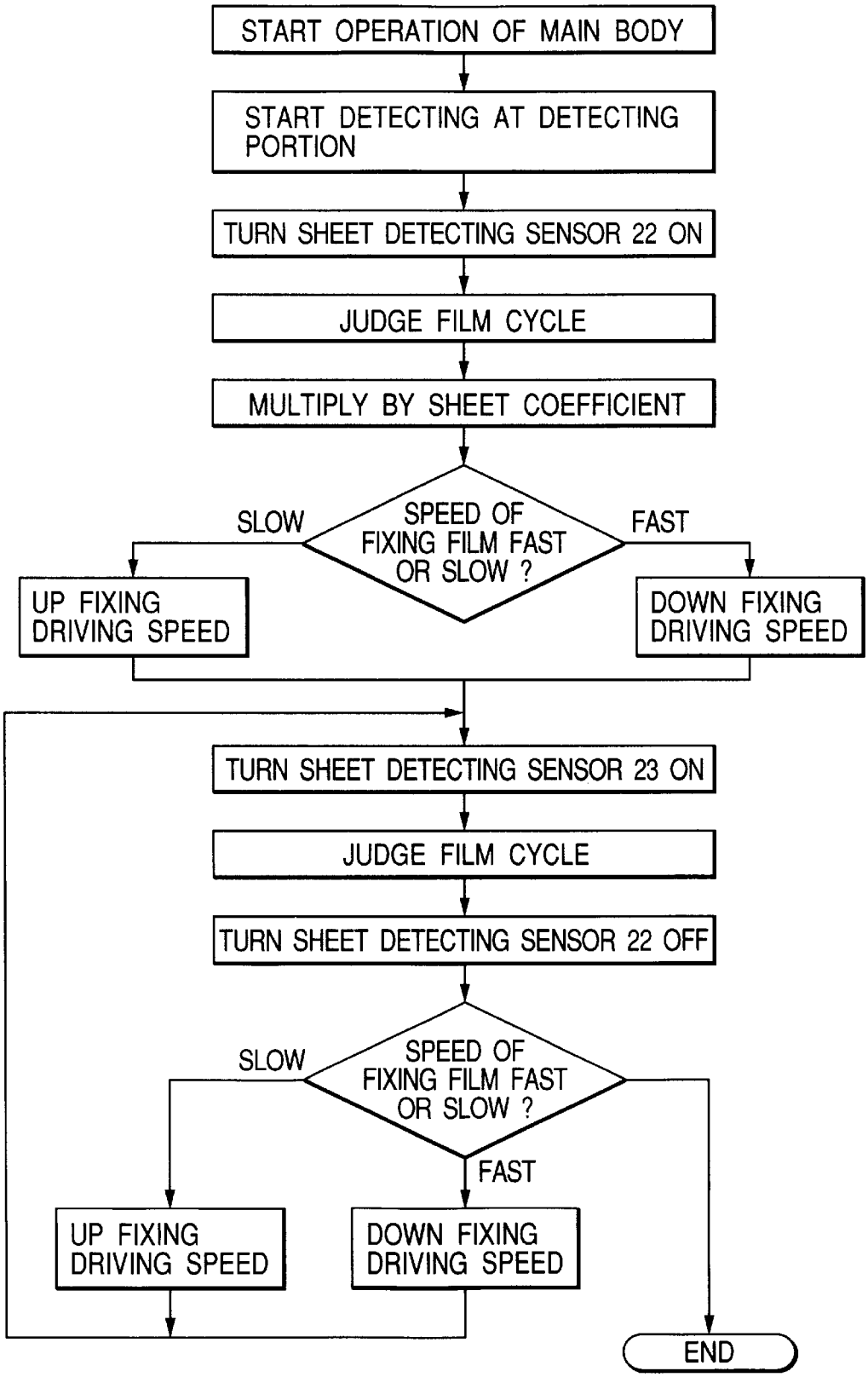
FIG. 8 is a flowchart to show specific control.

FIG. 8 is a flowchart to show the specific control.

(1) Control for First Sheet

When the power of the main body of the image forming apparatus is turned on, the rotational driving of the pressing roller 18 in the fixing apparatus 118 is initiated and the heater 13 is energized, whereby the fixing portion N is controlled to a predetermined temperature.

During that period, the temperature of the pressing roller 18 also increases, so that the pressing roller 18 starts undergoing thermal expansion. For this reason, the peripheral velocity of rotation of the pressing roller 18 increases and, at the same time as it, the rotational speed of the fixing film 12 also starts increasing as shown in FIG. 7. However, the rotational speed is naturally slower than the desired speed.

The reflection sensor 21 always detects the cycle (rotation cycle) of the fixing film.

When the sheet P reaches the flag portion 24 of the first sheet detecting sensor (photointerrupter) 22, the first sheet detecting sensor 22 is turned on. At this time the CPU 100 picks up the latest data D1 of the fixing film cycle.

The CPU 100 compares the data D1 with a target fixing film cycle T and, based thereon, it increases or decreases the fixing drive speed. In the case of the first sheet, however, the following has to be taken into consideration.

Figure 9:
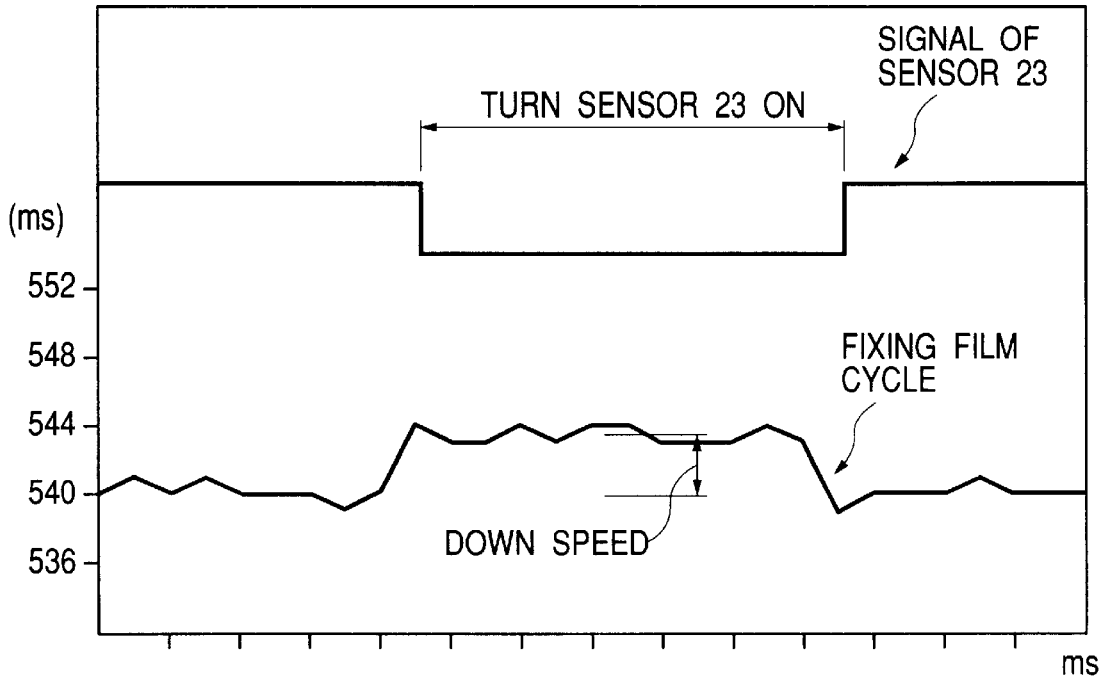
FIG. 9 is a chart to show change of the fixing film cycle during a passing period of a sheet through the image forming apparatus, without control of speed.

Namely, FIG. 9 is a graph to show change in the fixing film cycle during passage of one sheet P through the image forming apparatus, without speed control. It is apparent from this graph that the fixing film cycle is longer during the period in which the sheet P stays at the fixing portion N. The percentage of the increase was found to be about 0.8% by experiment.

This means that if the fixing driving speed is set on the basis of the aforementioned fixing film cycle data D1 the fixing film speed will be actually slower than the desired speed, i.e., the speed of the sheet will also be slower, so as to cause irregularity of imagery.

Therefore, the comparison with the target fixing film cycle T is made using fixing film cycle data D1*a* which is the product of the fixing film cycle data D1 and a sheet coefficient A for correction for the increase of the fixing film cycle due to the passage of the sheet.

D1*a*=A*D1 (A: sheet coefficient, A=1.008 in the present embodiment)

Then the increase or decrease of the fixing driving speed is immediately carried out whereby the rotational speed of the fixing film 12 can be maintained at the desired speed upon arrival of the first sheet at the fixing apparatus 118. Thus the conveying speed of the sheet P is also set similarly at the desired speed. Accordingly, the apparatus can yield excellent images.

(2) Control for Second Sheet and Thereafter

When the first sheet P reaches the flag portion 25 of the second sheet detecting sensor (photointerrupter) 23, the second sheet detecting sensor 23 is turned on. At this time the latest data D2 of the fixing film cycle is picked up by the CPU 100.

Since the sheet P is located at the fixing portion N at this time, there is no need for multiplying the fixing film cycle data D2 by the sheet coefficient A, different from the case of the first sheet, and the fixing film cycle data D2 can be compared with the target fixing film cycle T.

When there arises a need for changing the speed of the motor M2, a problem will come up if the speed of the motor M2 is immediately changed at that point. Namely, the trailing edge of the sheet P is often still present at the image transferring portion T. If at this time a sudden change is made in the speed of the sheet P in the fixing apparatus 118, vibration caused by the change can transfer through the sheet to cause a blur in the image.

Therefore, the apparatus herein is arranged not to change the motor speed immediately but to change it to the desired speed after a lapse of E sec since off of the first sheet detecting sensor 22. E sec is set as a time enough for the trailing edge of the sheet to pass through the image transferring portion R after passage through the first sheet detecting sensor 22. Namely, the speed of the motor M2 is changed after the sheet has passed completely through the image transferring portion T.

Then the second sheet is conveyed at the motor speed set herein. When the leading edge of the second sheet reaches the sheet detecting sensor 25, the photointerrupter 23 is turned on. At this point the CPU 100 picks up the latest data D3 of the fixing film cycle.

Then the CPU 100 compares the fixing film cycle data D2 with the target fixing film cycle T. determines the next motor speed, and changes the speed of the motor M2 at the timing as described above.

The above operation is repeated for sheets thereafter.

d) Cleaning Member 31 for Reflecting Material 20

In FIG. 4, the reflecting material 20 on the fixing film 12 is a coating on an exposed portion of the electroconductive layer of the fixing film 12, i.e., on an exposed portion 12*a* of the electroconductive primer layer which joins the base layer and the coating layer of the fixing film 12 to each other. The electroconductive primer layer is, for example, of the structure of [PTFE+PFA+PI+primer agent+conducting agent]. The reflecting material 20 is also electrically conductive and is, for example, of the structure of [PFA+$TiO_2$+silver+electroconductive filler]. This material is applied onto the exposed portion 12*a* and the coating is baked to form and provide the reflecting material 20.

Figure 5A:
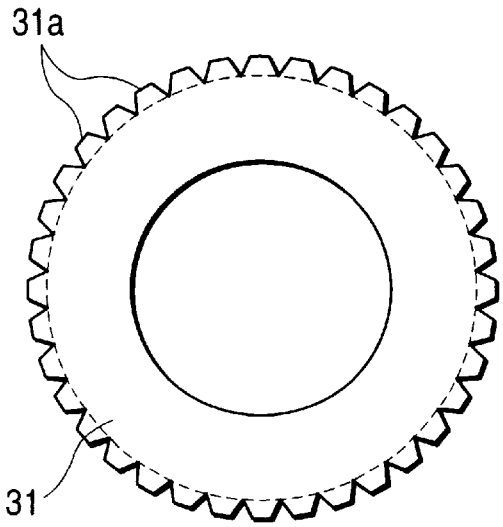
FIGS. 5A and 5B are a side view and a sectional view of a reflecting material cleaning member.
Figure 5B:
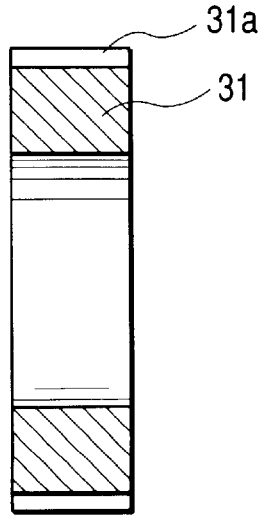

The reflecting material cleaning member 31, as shown in FIGS. 5A and 5B, is a ring-shaped member or cylindrical member of an electroconductive rubber in which the peripheral surface is of a knurled shape 31*a*, the outside diameter is almost the same as that of the rubber roller portion 18*b* of the pressing roller 18, and the inside diameter is a little smaller than the outside diameter of the core 18*a*.

This reflecting material cleaning member 31 is press-fitted onto the core 18*a* of the pressing roller 18 to be placed on and around the core 18*a*, whereby the cleaning member 31 is coaxially supported on the pressing roller 18 so as to rotate together with the pressing roller 18.

Figure 6:
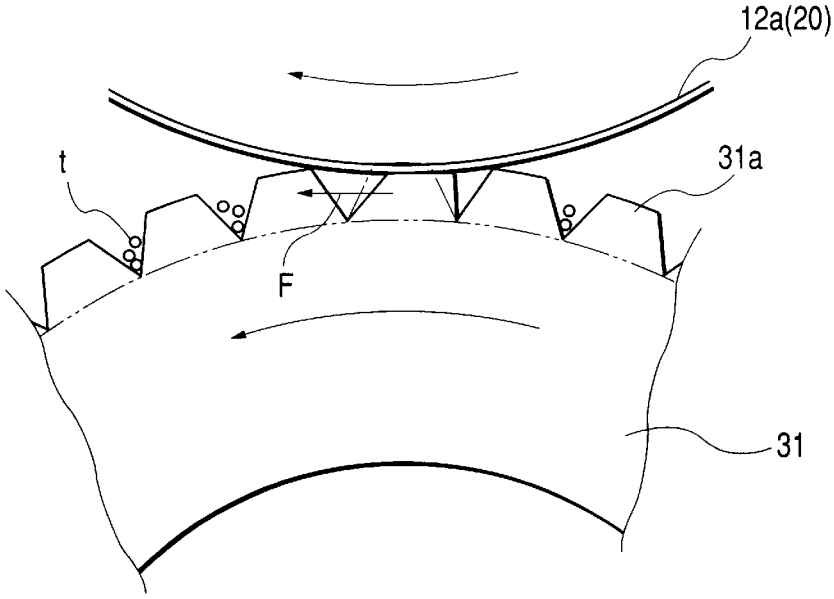
FIG. 6 is an illustration to illustrate the cleaning action.

This reflecting material cleaning member 31 is located in correspondence with the exposed portion 12*a* of the conductive primer layer where the reflecting material 20 of the fixing film 12 is formed and provided, and is brought in contact with the portion 12*a*. Namely, the reflecting material cleaning member 31 is placed at the position where it is always brought into contact with the reflecting material 20 every time the reflecting material 20 rotates once with rotation of the fixing film 12. In this case, as shown in FIG. 6, each of the teeth of the knurled shape 31*a* in the peripheral surface of the reflecting material cleaning member 31 is brought in such a contact state as to be slightly squeezed relative to the exposed portion 12*a* of the conductive primer layer including the reflecting material 20 of the fixing film 12.

In this structure, the fixing film 12 also rotates with the rotational driving of the pressing roller 18 to rotate the reflecting material cleaning member 31 and the exposed portion 12*a* of the conductive primer layer with the reflecting material 20 of the fixing film 12 formed and provided thereon, in contact with each other. Every time the fixing film 12 rotates by one cycle, the surface of the reflecting material 20 is cleaned by contact with the cleaning member 31.

Namely, even if toner is deposited on the light reflecting material 20, each tooth of the knurled shape 31*a* in the peripheral surface of the cleaning member 31 goes into contact with the reflecting material 20 while being a little squeezed as described above, as shown in FIG. 6. At an end of the contact, the tooth starts returning to the original state to generate a returning force F. The tooth rubs the surface of the reflecting material 20 under the returning force F to scrape off the toner t deposited thereon. The toner t thus scraped off then drops into between the teeth of the knurled shape 31*a*, so that the surface of the cleaning member 31 to contact the reflecting material 20 again becomes clean and starts cleaning of the reflecting material 20.

Since the reflecting material 20 is made of the fluorine base material and has better toner releasability than the electroconductive rubber of the cleaning member 31, the toner on the surface of the reflecting material 20 is more likely to be attracted to the cleaning member 31.

With operation over long periods of time, the projected portions of the teeth are shaved off in the knurled shape 31*a* in the peripheral surface of the cleaning member 31 and the toner t dropping into the valley portions also accumulates there. However, since the cleaning member 31 is a member separated from the pressing roller 18, it can be replaced with another. It is thus feasible to continue excellent cleaning operation again by simply replacing only the cleaning member 31 with a new one.

In the apparatus of the present embodiment, the charge accumulated in the fixing film 12 is drained from the exposed portion 12*a* of the conductive layer through the reflective material cleaning member 31 of the electroconductive rubber and the core 18*a* of the pressing roller 18 to the main body of the image forming apparatus by an unillustrated method.

In the present embodiment, as described above, the cleaning member 31 for the reflecting material 20 as a coating on the fixing film 12 is the rubber member which has the outer peripheral surface of the knurled shape 31*a* formed on the opposite side where it can go into contact with the reflecting material 20 and which is placed on the same axis as the pressing roller and is arranged to be rotatable together with the pressing member, whereby the surface of the reflecting material 20 can be cleaned into a clean surface without being kept in the toner deposited state. For this reason, the rotational speed of the fixing film 12 can be always accurately detected and this permits the apparatus to form excellent images.

Since the rubber member as the cleaning member 31 is formed in the knurled shape 31*a*, the lifetime thereof can be increased.

Since the rubber member as the cleaning member 31 is made of the material with the lower toner releasability than the reflecting material 20, more toner can be collected from the surface of the reflecting material.

Since the rubber member as the cleaning member 31 is mounted in the replaceable state, only the cleaning member 31 can be replaced when contaminated or worn, and thus the cost for replacement is small.

Since the rubber member as the cleaning member 31 also serves as the electroconductive member for draining the charge accumulated in the fixing film 12, the number of components can be reduced and products can be made at lower cost.

(3) Other Embodiments

1) The heating apparatus of the present invention is not limited to the image heating-fixing apparatus of the embodiment, but can also be commonly used, of course, as apparatus for heating a recording material with an image borne thereon to improve the surface property (gloss or the like), prefixing apparatus, and heating apparatus for performing a drying process, a laminating process, or other processes on a sheetlike object as fed thereto.

2) The film may be extended with tension between extending members.

3) The heating body is not limited to the ceramic heater, but can be any other heater, e.g., an electromagnetic induction heating member. The film itself can be constructed of the electromagnetic induction heating member or one including an electromagnetic induction heating layer.

4) The pressing member is not limited to the roller body, but may be any other rotor such as a rotating belt or the like.

5) It is a matter of course that the material, member configuration, arrangement, etc. of the member for cleaning the reflecting member on the film side are not limited to those in the aforementioned embodiment.

The embodiments of the present invention were described above, but it should be noted that the invention is not limited to these embodiments but can be modified in all conceivable forms within the technical idea of the invention.

What is claimed is:

1. An image heating apparatus comprising:

a heating body;

an endless belt moving in contact with said heating body, said endless belt having a mark portion;

a pressing member forming a nip for nipping and conveying a recording material in cooperation with said endless belt;

detecting means for optically detecting the mark portion of said endless belt;

control means for controlling a driving speed of said endless belt based on an output of said detecting means; and an electroconductive cleaning member for cleaning the mark portion wherein said pressing member is of roll shape and said cleaning member is disposed on the same axis as said pressing member.

2. An image heating apparatus according to claim 1, wherein said endless belt is driven by said pressing member and said control means controls a driving speed of said pressing member.

3. An image heating apparatus according to claim 1, wherein said pressing member has a core and said endless belt electrically conducts through the cleaning member to the core.

4. An image heating apparatus according to claim 3, wherein said endless belt includes an electroconductive layer and the mark portion is provided on the electroconductive layer.

5. An image heating apparatus according to claim 4, wherein the mark portion is electrically conductive.

6. An image heating apparatus according to claim 4, wherein the electroconductive layer on which the mark portion is provided is a primer layer for adhesion of a surface release layer.

7. An image heating apparatus according to claim 1, wherein an outside shape of said cleaning member is a knurled shape.

8. An image heating apparatus according to claim 7, wherein said cleaning member has rubber elasticity.

9. An image heating apparatus according to claim 1, wherein said endless belt is of film shape.

* * * * *

UNITED STATES PATENT AND TRADEMARK OFFICE

CERTIFICATE OF CORRECTION

PATENT NO. : 6,704,526 B2
DATED : March 9, 2004
INVENTOR(S) : Tomokazu Nakamura

It is certified that error appears in the above-identified patent and that said Letters Patent is hereby corrected as shown below:

Column 5,
Line 29, “has” should read -- have --.
Line 57, “has” should read -- having --.

Column 8,
Line 16, “grater” should read -- greater --.

Column 9,
Line 39, “cycle T.” should read -- cycle T, --.

Signed and Sealed this

Twenty-ninth Day of June, 2004

JON W. DUDAS
*Acting Director of the United States Patent and Trademark Office*